US011306502B2

(12) United States Patent
Chen

(10) Patent No.: US 11,306,502 B2
(45) Date of Patent: Apr. 19, 2022

(54) SUNSHADE SUPPORT AND SUNSHADE

(71) Applicant: NANJING KEKANG OUTDOOR PRODUCTS CO., LTD, Nanjing (CN)

(72) Inventor: Meidi Chen, Nanjing (CN)

(73) Assignee: Nanjing Kekang Outdoor Products Co., Ltd., Nanjing (CN)

( * ) Notice: Subject to any disclaimer, the term of this patent is extended or adjusted under 35 U.S.C. 154(b) by 0 days.

(21) Appl. No.: 17/097,272

(22) Filed: Nov. 13, 2020

(65) Prior Publication Data

US 2022/0064982 A1 Mar. 3, 2022

(30) Foreign Application Priority Data

Aug. 28, 2020 (CN) ..... 202010885122.9

(51) Int. Cl.
*E04H 15/50* (2006.01)
*E04H 15/60* (2006.01)

(52) U.S. Cl.
CPC ..... *E04H 15/50* (2013.01); *E04H 15/60* (2013.01)

(58) Field of Classification Search
CPC ..... E04H 15/50; E04H 15/60
See application file for complete search history.

(56) References Cited

U.S. PATENT DOCUMENTS

| | | | | |
|---|---|---|---|---|
| 4,256,129 | A * | 3/1981 | Gilsenan | E04H 15/50 135/143 |
| 5,499,646 | A * | 3/1996 | Lee | E04H 15/28 135/121 |
| 10,273,710 | B2 * | 4/2019 | Yang | E04H 15/50 |
| 10,822,829 | B1 * | 11/2020 | Lu | E04H 15/48 |
| 10,941,585 | B2 * | 3/2021 | Sun | E04H 15/32 |
| 11,002,036 | B1 * | 5/2021 | Zhang | E04H 15/50 |
| 2018/0209167 | A1 * | 7/2018 | Yang | E04H 15/44 |
| 2018/0298631 | A1 * | 10/2018 | Yang | E04H 15/46 |
| 2019/0234102 | A1 * | 8/2019 | Lu | E04H 15/46 |
| 2019/0277053 | A1 * | 9/2019 | Yang | E04H 15/58 |
| 2019/0368232 | A1 * | 12/2019 | Sun | E05B 65/00 |
| 2020/0181938 | A1 * | 6/2020 | Xu | E04H 15/46 |

* cited by examiner

*Primary Examiner* — Noah Chandler Hawk
(74) *Attorney, Agent, or Firm* — Bay State IP, LLC

(57) ABSTRACT

A sunshade support and a sunshade, which includes an intermediate connecting tube, a buckle structure and a connecting piece, wherein the top end of the intermediate connecting tube is connected with the connecting piece, a top folding tube is distributed along the circumferential direction of the connecting piece; the bottom end of the intermediate connecting tube is inserted into the buckle structure, a supporting short tube is distributed along the circumferential direction of the buckle structure and the end of the supporting short tube away from the buckle structure is connected with the corresponding top folding tube, respectively; a button part is provided on the buckle structure, the intermediate connecting tube is inserted into the buckle structure when pressing or pushing the button part, and the buckle structure is capable of being fixed on the intermediate connecting tube when the applied force on the button part is released.

5 Claims, 6 Drawing Sheets

SUNSHADE SUPPORT AND SUNSHADE

CROSS REFERENCE TO RELATED APPLICATION

This application claims the benefit of and takes priority from Chinese Patent Application Serial No. 202010885122.9 filed on Aug. 28, 2020, the contents of which are herein incorporated by reference.

BACKGROUND OF THE INVENTION

Field of the Invention

The present invention relates to the technical field of sunshades, in particular to a sunshade support and a sunshade comprising the sunshade support.

Description of the Related Art

People often use sunshades to keep out the hot sun when they are relaxing and entertaining outdoors. In the past, the latch fasteners of the sunshade were on the four legs. When in use, the sunshade was opened and the plastic buckles on the four legs were clamped to lock the entire folding sunshade structure. However, the disadvantage is that people need to lock all the plastic buckles on the four corners, which is very inconvenient to use.

SUMMARY OF THE INVENTION

The object of the present invention is to provide a sunshade support and a sunshade comprising the sunshade support, solving the technical problem that the structure of the existing sunshade support in the prior art makes it difficult and laborious to lock and support the support. The many technical effects that can be produced by the preferred technical solutions among the many technical solutions provided by the present invention are described in detail hereinafter.

In order to achieve the above object, the present invention provides the following technical solutions.

The present invention provides a sunshade support, comprising an intermediate connecting tube, a buckle structure and a connecting piece, wherein: the top end of the intermediate connecting tube is connected with the connecting piece, a top folding tube is distributed along the circumferential direction of the connecting piece; the bottom end of the intermediate connecting tube is inserted into the buckle structure, a supporting short tube is distributed along the circumferential direction of the buckle structure and the end of the supporting short tube away from the buckle structure is connected with the corresponding top folding tube, respectively; a button part is provided on the buckle structure, the intermediate connecting tube is inserted into the buckle structure when pressing or pushing the button part, and the buckle structure is capable of being fixed on the intermediate connecting tube when the applied force on the button part is released.

Further, the buckle structure is provided with a central hole that matches with the intermediate connecting tube, a notch is provided on the side wall of the intermediate connecting tube, when the intermediate connecting tube is inserted into the central hole and is inserted in position, part of the structure of the button part is located in the notch to clamp the intermediate connecting tube on the buckle structure.

Further, the buckle structure comprises a main body part and an elastic member, the main body part is provided with the central hole, the button part is connected with the main body part, the button part is movable or rotatable in the horizontal direction with respect to the main body part, and the elastic member is located in the main body part and connects the button part with the main body part; the button part is pressed or pushed for inserting the intermediate connecting tube into the central hole, and when the applied force on the button part is released, the button part moves in the reverse direction under the action of the elastic member so that part of the structure of the button part is located in the notch.

Further, the button part is inserted into the main body part from the side of the main body part, the elastic member is pressed against between the inner side wall of the main body part and one end of the button part inserted into the main body part; the button part is provided with a matching hole, when the button part is pressed, the matching hole and the central axis of the central hole are collinear so that the intermediate connecting tube is inserted into the central hole and passes through the matching hole, and when the applied force on the button part is released, the button part moves in the reverse direction under the action of the elastic member so that the edge area of the matching hole is located in the notch.

Further, a connecting hole is provided on the button part, a fixing member is inserted into the main body part and passes through the connecting hole so that the button part is connected with the main body part, the connecting hole is a waist-shaped hole, and the button part is movable in the direction of extending into or out of the main body part in the horizontal direction with respect to the fixing member.

Further, the main body part comprises an upper half and a lower half, the upper half is provided above the lower half, the upper half is detachably connected with the lower half, the button part is sandwiched between the upper half and the lower half, the button part is rotatably connected with the main body part, and the elastic member is sandwiched between the inner side wall of the main body part and the button part; the button part is provided with an arc-shaped notch, when the button part is pushed, the button part is rotatable to prevent the button part from interfering with the intermediate connecting tube inserted into the central hole, and when the applied force on the button part is released, the button part moves in the reverse direction under the action of the elastic member so that the edge area of the arc-shaped notch is located in the notch.

Further, a positioning column is provided on the upper half, the positioning column passes through the button part and is inserted into the lower half, and the button part is rotatably connected with the positioning column.

Further, a beam for suspending items is provided on the buckle structure, and the beam is located on the bottom surface of the buckle structure.

Further, the sunshade support further comprises a foot tube, one end of the four top folding tubes away from the connecting piece is connected to the corresponding foot tube, respectively, and a scissor-shaped cross iron tube is connected between two adjacent foot tubes in the circumferential direction of the sunshade support.

A sunshade comprises the sunshade support.

According to the sunshade support provided by the present invention, the intermediate connecting tube is inserted into the buckle structure when pressing or pushing the button part, and the buckle structure is capable of being fixed on the intermediate connecting tube when the applied force on the button part is released. When the sunshade support provided by the present invention is used, only one person is required to gently lift up the buckle structure from the middle vertically and allow the intermediate connecting tube to be clamped into the buckle structure, so as to lock the entire sunshade support structure; when the sunshade support is folded, the button part only needs to be pressed or pushed so that the intermediate connecting tube is separated from the buckle structure, so as to fold the entire folding sunshade support, which provides convenience for people when using the sunshade.

BRIEF DESCRIPTION OF THE DRAWINGS

In order to explain the embodiments of the present invention or the technical solutions in the prior art more clearly, the drawings that need to be used in the description of the embodiments or the prior art will be briefly introduced. Obviously, the drawings in the following description are only a part of the embodiments of the present invention. For those of ordinary skill in the art, other drawings can be obtained based on these drawings without creative work.

Figure 1:
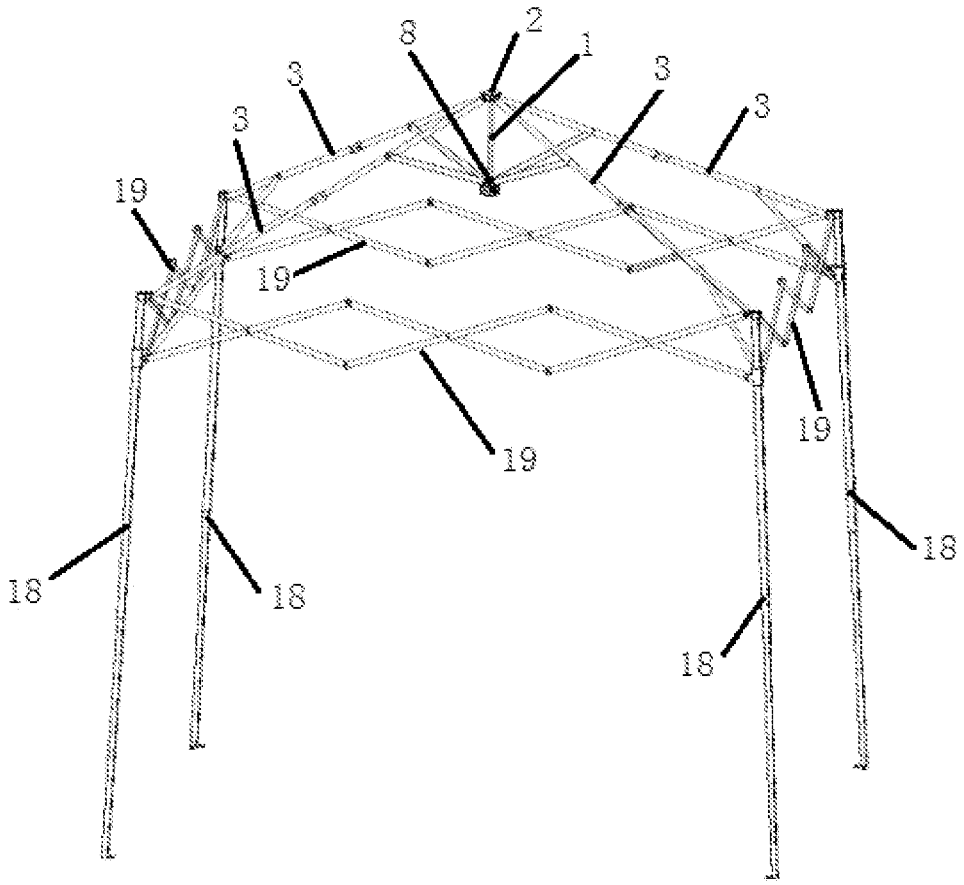
FIG. 1 is a schematic structural diagram of a sunshade support according to an embodiment of the present invention.

In the figures, 1—intermediate connecting tube; 2—connecting piece; 3—top folding tube; 4—supporting short tube; 5—button part; 6—central hole; 7—notch; 8—body part; 9—elastic member; 10—matching hole; 11—connecting hole; 12—fixing member; 13—upper half; 14—lower half; 15—arc—shaped notch; 16—positioning column; 17—beam; 18—foot tube; 19—scissor-shaped cross iron tube; 20—round head plastic; 21—mounting groove; 23—fixing screw.

DETAILED DESCRIPTION OF THE SEVERAL EMBODIMENTS

In order to make the objectives, technical solutions and advantages of the present invention clearer, the technical solutions of the present invention will be described in detail hereinafter. Obviously, the described embodiments are only a part of the embodiments of the present invention, rather than all the embodiments. Based on the embodiments of the present invention, all other embodiments obtained by those skilled in the art without creative work shall fall within the protection scope of the present invention.

Referring to FIGS. 1 to 10, the present invention provides a sunshade support, which comprises an intermediate connecting tube 1, a buckle structure and a connecting piece 2, wherein the top end of the intermediate connecting tube 1 is connected with the connecting piece 2, the connecting piece 2 is a plastic part, a top folding tube 3 is distributed along the circumferential direction of the connecting piece 2, and the top folding tube 3 is rotatably connected to the connecting piece 2; the bottom end of the intermediate connecting tube 1 is inserted into the buckle structure, a supporting short tube 4 is distributed along the circumferential direction of the buckle structure and the end of the supporting short tube 4 away from the buckle structure is connected with the corresponding top folding tube 3, respectively, the supporting short tube 4 is rotatably connected to the buckle structure, the top folding tube 3 4 is rotatably connected to the supporting short tube 4; a button part 5 is provided on the buckle structure, the intermediate connecting tube 1 is inserted into the buckle structure when pressing or pushing the button part 5, and the buckle structure is capable of being fixed on the intermediate connecting tube 1 when the applied force on the button part 5 is released. When the sunshade support provided by the present invention is used, only one person is required to gently lift up the buckle structure from the middle vertically and allow the intermediate connecting tube 1 to be clamped into the buckle structure, so as to lock the entire sunshade support structure; when the sunshade support is folded, the button part 5 only needs to be pressed or pushed so that the intermediate connecting tube 1 is separated from the buckle structure, so as to fold the entire folding sunshade support, which provides convenience for people when using the sunshade. The buckle structure is novel in locking method, simple in principle, convenient to install and operate, and cost-saving.

In addition, referring to FIG. 1, the sunshade support further comprises foot tubes 18, one end of the four top folding tubes 3 away from the connecting piece 2 is connected to the corresponding foot tube 18, respectively, a scissor-shaped cross iron tube 19 is connected between two adjacent foot tubes 18 in the circumferential direction of the sunshade support, and the four supporting short tubes 4 are connected with the corresponding top folding tube 3, respectively.

Figure 2:
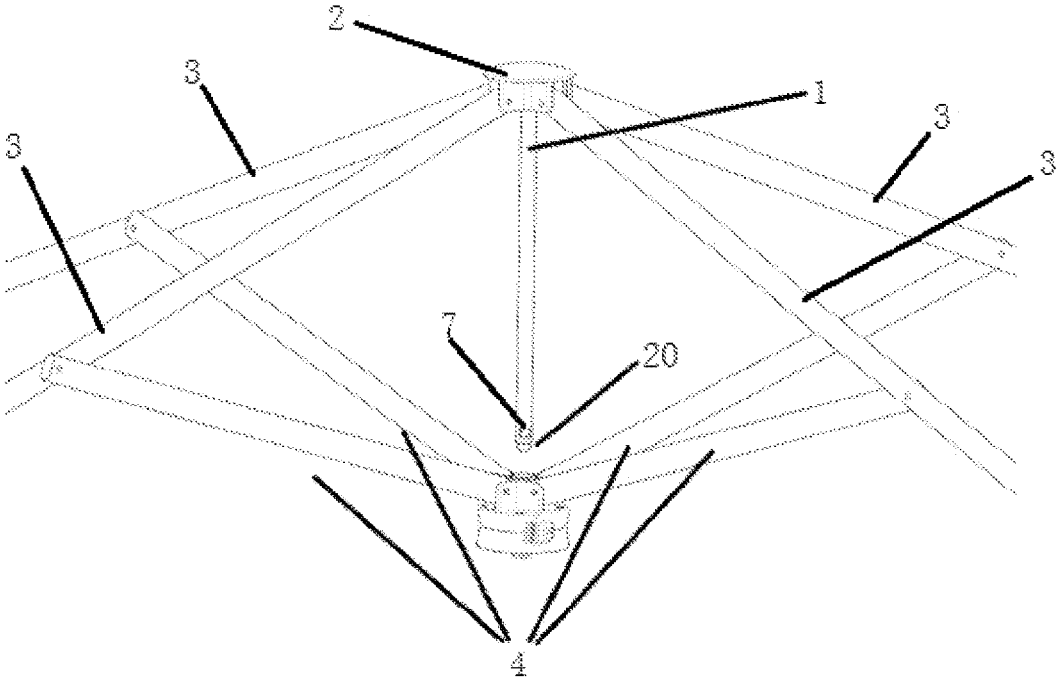
FIG. 2 is a schematic structural diagram of an intermediate connecting tube without being inserted into the buckle structure according to an embodiment of the present invention.
Figure 3:
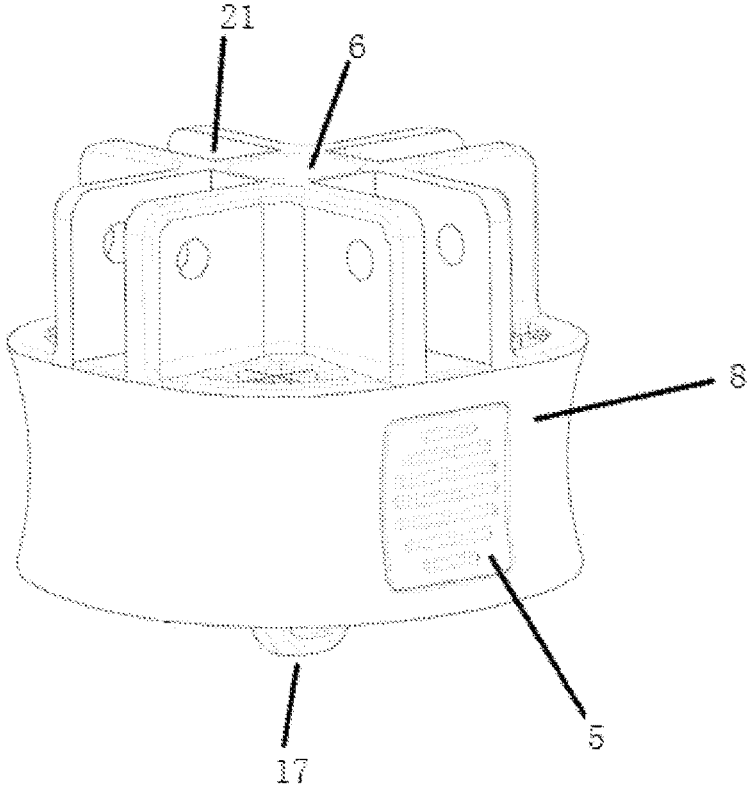
FIG. 3 is a schematic structural diagram of a buckle structure according to an embodiment of the present invention (a press-type buckle)
Figure 4:
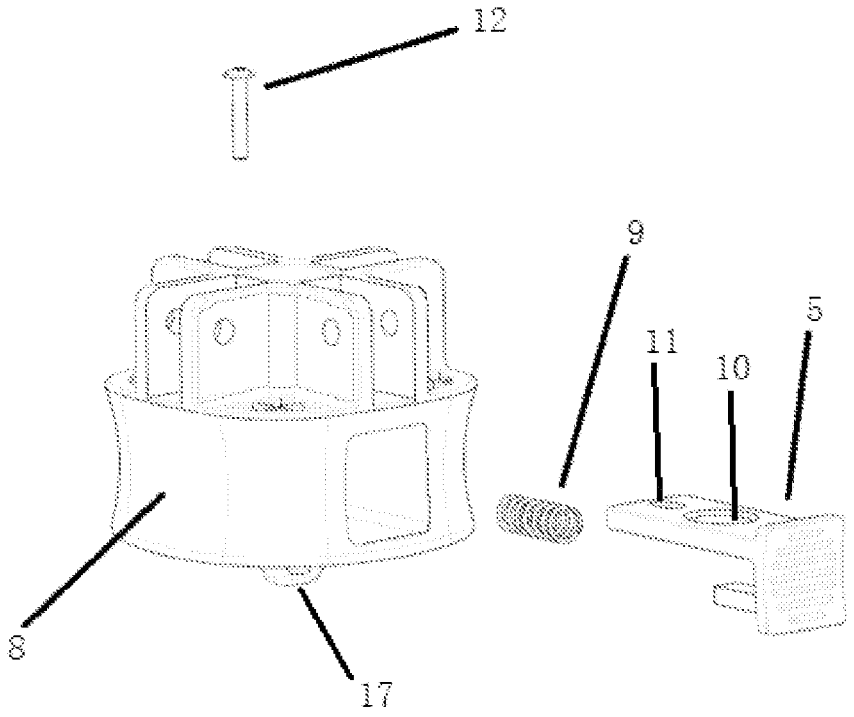
FIG. 4 is an exploded schematic diagram of a buckle structure shown in FIG. 3.

Refer to FIGS. 2 and 3 for the connection structure of the buckle structure and the supporting short tube 4. The buckle structure is formed with a mounting groove 21. The end of the supporting short tube 4 is pressed into a sheet structure and is inserted into the mounting groove 21, which is connected by a connecting pin, so as to realize the rotational connection between the supporting short tube 4 and the buckle structure. In addition, the connection structure between the top folding tube 3 and the connector 2 is the same as the connecting structure between the supporting short tube 4 and the buckle structure.

As a preferable implementation of the embodiment of the present invention, the principle that the buckle structure is locked on the intermediate connecting tube 1 may be as follows: the buckle structure is provided with a central hole 6 that matches with the intermediate connecting tube 1, and a notch 7 is provided on the side wall of the intermediate connecting tube 1. Refer to FIG. 2, which shows the notch 7 on the intermediate connecting tube 1. When the intermediate connecting tube 1 is inserted into the central hole 6 and is inserted in position, part of the structure of the button part 5 is located in the notch 7 to clamp the intermediate connecting tube 1 on the buckle structure. Referring to FIG. 2, the lower end of the intermediate connecting tube 1 is connected with a round plastic 20, so that the intermediate connecting tube 1 can be smoothly inserted into the central hole 6 of the buckle structure. The specific structure of the buckle structure can be as follows: the buckle structure comprises a main body part 8 and an elastic member 9, and the main body part 8 is provided with the central hole 6, which is a blind hole. That is, the central hole 6 does not penetrate the bottom surface of the main body part 8. The button part 5 is connected with the main body part 8, the button part 5 is movable or rotatable in the horizontal direction with respect to the main body part 8, and the elastic member 9 is located in the main body part 8 and connects the button part 5 with the main body part 8; the button part 5 is pressed or pushed for inserting the intermediate connecting tube 1 into the central hole 6, and when the applied force on the button part 5 is released, the button part 5 moves in the reverse direction under the action of the elastic member 9 so that part of the structure of the button part 5 is located in the notch 7. When the intermediate connecting tube 1 is not inserted into the central hole 6, the button part 5 is restricted by the elastic member 9 and the main body part 8, and part of the structure of the button part 5 is located in the central hole 6; the button part 5 is pressed or pushed so that part of the structure of the button part 5 is separated from the central hole 6 so that the intermediate connecting tube 1 is smoothly inserted into the central hole 6, until the intermediate connecting tube 1 is in contact with the bottom surface of the central hole 6; then the applied force on the button part 5 is released. The button part 5 moves in the reverse direction under the action of the elastic member 9, so that part of the structure of the button part 5 is located in the notch 7. The intermediate connecting tube 1 is clamped on the buckle structure, so that the intermediate connecting tube 1 is fixed to the position of the buckle structure, so as to lock the entire sunshade support structure.

Figure 5:
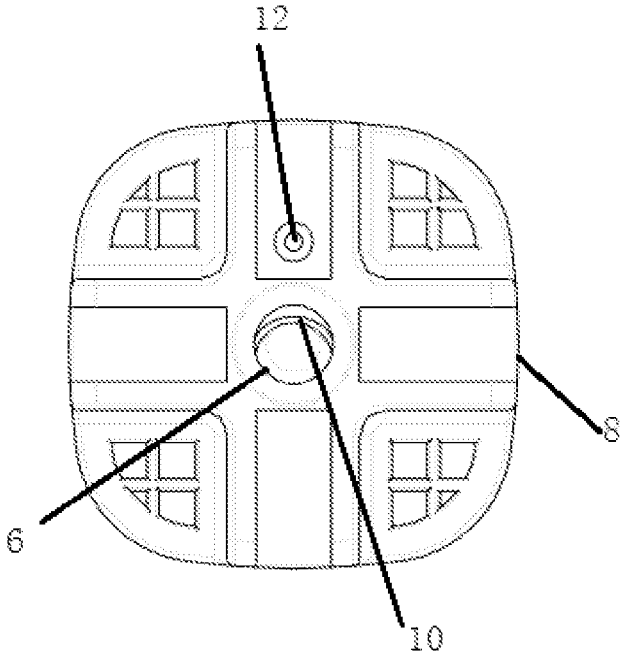
FIG. 5 is a schematic top diagram of a buckle structure shown in FIG. 3.

As a preferable implementation of the embodiment of the present invention, when the button part 5 can be pressed, the specific structure of the buckle structure may be as follows: referring to FIGS. 3-6, the buckle structure may be a plastic part, the button part 5 is inserted into the main body part 8 from the side of the main body part 8, the elastic member 9 is pressed against between the inner side wall of the main body part 8 and one end of the button part 5 inserted into the main body part 8; the button part 5 is provided with a matching hole 10, when the button part 5 is pressed, the matching hole 10 and the central axis of the central hole 6 are collinear so that the intermediate connecting tube 1 is inserted into the central hole 6 and passes through the matching hole 10, when the applied force on the button part 5 is released, the button part 5 moves in the reverse direction under the action of the elastic member 9 so that the edge area of the matching hole 10 is located in the notch 7, and when the button part 5 is pressed, the button part 5 moves and squeezes the elastic member 9, which may be a spring. Referring to FIG. 5, a schematic diagram of the buckle structure when the button part 5 is not pressed is shown. From the figure, the edge area of the matching hole 10 can be seen. When the intermediate connecting tube 1 is fixed on the buckle structure, as shown in FIG. 5, the edge area of the matching hole 10 is located in the notch 7 of the intermediate connecting tube 1. When the intermediate connecting tube 1 needs to be pulled out of the buckle structure, the button part 5 is pressed, so that the edge area of the matching hole 10 is separated from the notch 7 on the intermediate connecting tube 1, so that the intermediate connecting tube 1 can be pulled out.

Figure 6:
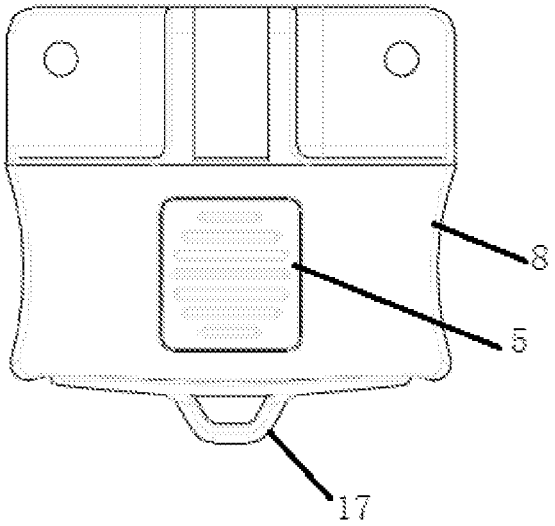
FIG. 6 is a schematic front diagram of a buckle structure shown in FIG. 3.

Referring to FIGS. 3-6, a connecting hole 11 is provided on the button part 5, a fixing member 12 is inserted into the main body part 8 and passes through the connecting hole 11 so that the button part 5 is connected with the main body part 8, the connecting hole 11 is a waist-shaped hole, and the button part 5 is movable in the direction of extending into or out of the main body part 8 in the horizontal direction with respect to the fixing member 12. Referring to FIG. 6, anti-slip patterns are provided on the part of the button part 5 in contact with the hand, and the edge user uses the thumb for pressing operation. The overall shape of the plastic buckle structure is designed according to ergonomics. The entire plastic latch fastener fits the shape of the hand, and can easily hold and lift up the plastic buckle structure to achieve lock, and it is also suitable when unlocked. The finger comfortably presses the unlock button to fold the folding sunshade.

Figure 7:
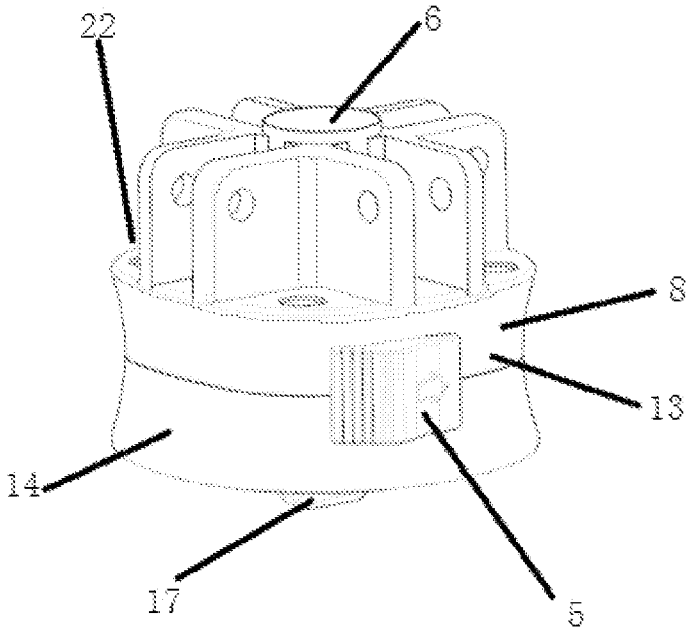
FIG. 7 is another schematic structural diagram (a push-type buckle) of a buckle structure according to an embodiment of the present invention.
Figure 8:
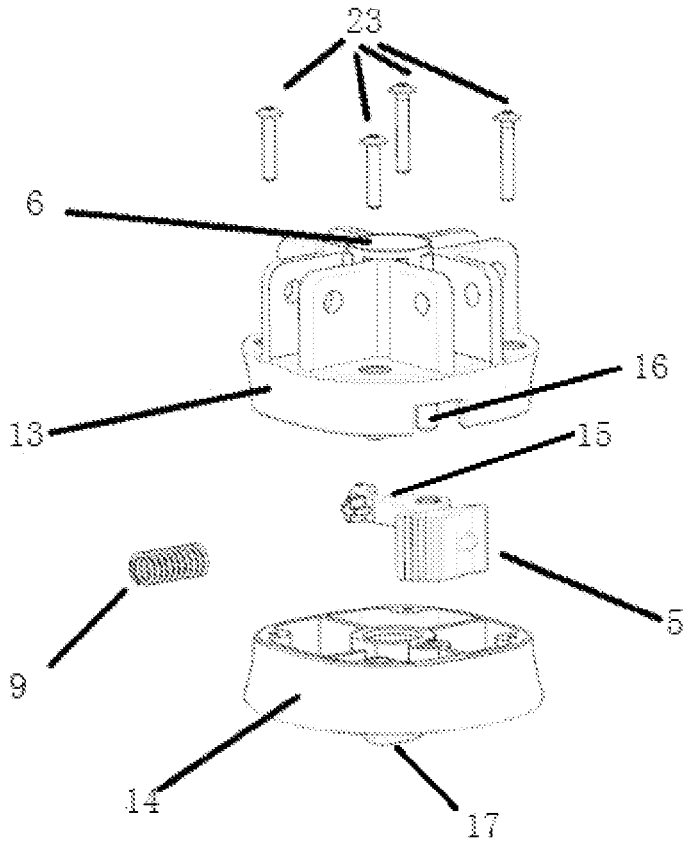
FIG. 8 is an exploded schematic diagram of a buckle structure shown in FIG. 7.
Figure 9:
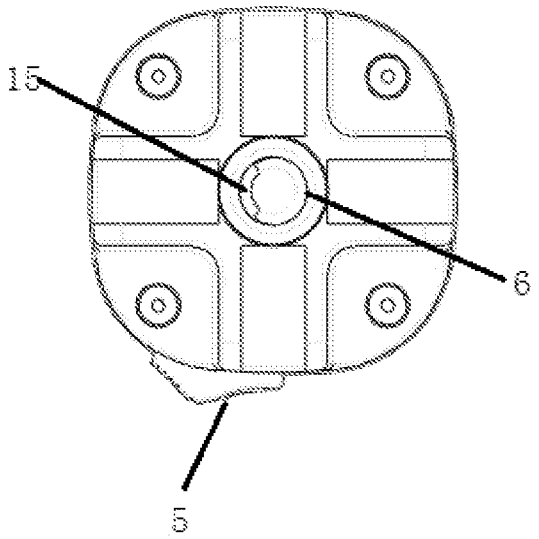
FIG. 9 is a schematic top diagram of a buckle structure shown in FIG. 7.
Figure 10:
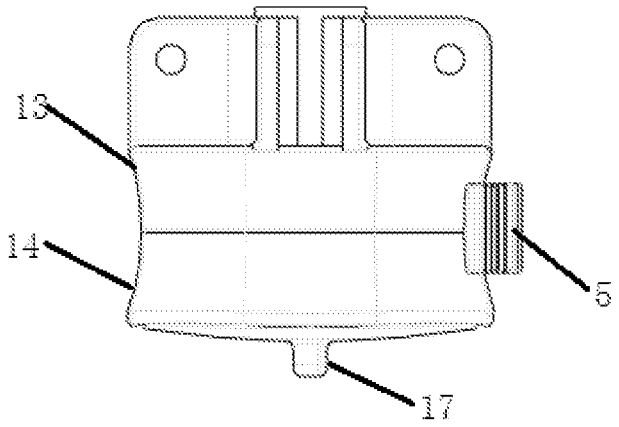
FIG. 10 is a schematic front diagram of a buckle structure shown in FIG. 7.

As a preferable implementation of the embodiment of the present invention, when the button part 5 can be pushed, the specific structure of the buckle structure may be as follows: referring to FIGS. 7-10, the buckle structure may be a plastic part, the main body part 8 comprises an upper half 13 and a lower half 14 (that is, the main body part 8 is a split structure), the upper half 13 is provided above the lower half 14, the upper half 13 is detachably connected with the lower half 14, the button part 5 is sandwiched between the upper half 13 and the lower half 14, and the button part 5 is rotatably connected with the main body part 8. Referring to FIGS. 7 and 8, the upper part 13 is provided with a groove structure that can accommodate the button part 5. The button part 5 is supported on the lower half 14 to be located in the groove structure of the upper half 13. The elastic member 9 is sandwiched between the inner side wall of the main body part 8 and the button part 5; the button part 5 is provided with an arc-shaped notch 15, when the button part 5 is pushed, the button part 5 is rotatable to prevent the button part 5 from interfering with the intermediate connecting tube 1 inserted into the central hole 6, and when the applied force on the button part 5 is released, the button part 5 moves in the reverse direction under the action of the elastic member 9 so that the edge area of the arc-shaped notch 15 is located in the notch 7. Refer to FIG. 9, which shows a schematic diagram of a buckle structure when the button part 5 is not pushed. From FIG. 9, the edge area of the arc-shaped notch 15 can be seen. When the intermediate connecting tube 1 is clamped on the buckle structure, the edge area of the arc-shaped notch 15 shown in FIG. 9 is located in the notch 7 of the intermediate connecting tube 1. When the intermediate connecting tube 1 needs to be pulled out of the buckle structure, the button part 5 is pushed counterclockwise so that the edge area of the arc-shaped notch 15 is separated from the notch 7 on the intermediate connecting tube 1, so that the intermediate connecting tube 1 can be pulled out.

A positioning column 16 is provided on the upper half 13, the positioning column 16 passes through the button part 5 and is inserted into the lower half 14, and the button part 5 is rotatably connected with the positioning column 16. An elastic member 9 is sandwiched between the inner side wall of the main body part 8 and the button part 5. The elastic member 9 can be a spring. When the button part 5 is pushed counterclockwise, the button part 5 moves and compresses the elastic member 9. The structure of the part of the button part 5 in contact with the hand should be convenient for the user to push the button part 5 with his fingers. The buckle structure is also designed according to ergonomics. The entire plastic latch fastener fits the shape of the hand, and can easily hold and lift up the plastic part to achieve lock. It can also be suitable for fingers to comfortably press the unlock button in the direction of the pointed side when unlocked, so as to fold the folding sunshade As a preferable implementation of the embodiment of the present invention, a beam 17 for suspending items is provided on the buckle structure, and the beam 17 is located on the bottom surface of the buckle structure. The beam 17 is convenient for suspending some items, such as lights, bags, nets, etc., with hooks.

A sunshade comprises the sunshade support provided by the present invention. The sunshade further comprises sunshade cloth (the cloth contains a reflective coating to effectively prevent ultraviolet rays), wind ropes, and floor nails. After the foldable sunshade is folded, it can be placed in an outer bag. According to the size and weight, a handbag or a trolley case can be chosen, which is convenient for storage and carrying.

The above are only specific embodiments of the present invention, but the protection scope of the present invention is not limited thereto. Any changes or substitutions conceivable to those skilled in the art within the technical scope disclosed by the present invention should be covered within the protection scope of the present invention. Therefore, the protection scope of the present invention should be subject to the protection scope of the claims.

What is claimed is:

1. A sunshade support, comprising an intermediate connecting tube (1), a buckle structure and a connecting piece (2), wherein:

the top end of the intermediate connecting tube (1) is connected with the connecting piece (2), a top folding tube (3) is distributed along the circumferential direction of the connecting piece (2); the bottom end of the intermediate connecting tube (1) is inserted into the buckle structure, a supporting short tube (4) is distributed along the circumferential direction of the buckle structure and the end of the supporting short tube (4) away from the buckle structure is connected with the corresponding top folding tube (3), respectively;

a button part (5) is provided on the buckle structure, the intermediate connecting tube (1) is inserted into the buckle structure when pressing or pushing the button part (5), and the buckle structure is capable of being fixed on the intermediate connecting tube (1) when the applied force on the button part (5) is released;

wherein the buckle structure is provided with a central hole (6) that matches with the intermediate connecting tube (1), a notch (7) is provided on the side wall of the intermediate connecting tube (1), when the intermediate connecting tube (1) is inserted into the central hole (6) and is inserted in position, part of the structure of the button part (5) is located in the notch (7) to clamp the intermediate connecting tube (1) on the buckle structure;

wherein the buckle structure comprises a main body part (8) and an elastic member (9), the main body part (8) is provided with the central hole (6), the button part (5) is connected with the main body part (8), the button part (5) is movable or rotatable in the horizontal direction with respect to the main body part (8), and the elastic member (9) is located in the main body part (8) and connects the button part (5) with the main body part (8);

the button part (5) is pressed or pushed for inserting the intermediate connecting tube (1) into the central hole (6), and when the applied force on the button part (5) is released, the button part (5) moves in the reverse direction under the action of the elastic member (9) so that part of the structure of the button part (5) is located in the notch (7);

wherein the main body part (8) comprises an upper half (13) and a lower half (14), the upper half (13) is provided above the lower half (14), the upper half (13) is detachably connected with the lower half (14), the button part (5) is sandwiched between the upper half (13) and the lower half (14), the button part (5) is rotatably connected with the main body part (8), and the elastic member (9) is sandwiched between the inner side wall of the main body part (8) and the button part (5);

the button part (5) is provided with an arc-shaped notch (15), when the button part (5) is pushed, the button part (5) is rotatable to prevent the button part (5) from interfering with the intermediate connecting tube (1) inserted into the central hole (6), and when the applied force on the button part (5) is released, the button part (5) moves in the reverse direction under the action of the elastic member (9) so that the edge area of the arc-shaped notch (15) is located in the notch (7); and wherein a positioning column (16) is provided on the upper half (13), the positioning column (16) passes through the button part (5) and is inserted into the lower half (14), and the button part (5) is rotatably connected with the positioning column (16).

2. The sunshade support according to claim 1, wherein the button part (5) is inserted into the main body part (8) from the side of the main body part (8), the elastic member (9) is pressed against between the inner side wall of the main body part (8) and one end of the button part (5) inserted into the main body part (8);

the button part (5) is provided with a matching hole (10), when the button part (5) is pressed, the matching hole (10) and the central axis of the central hole (6) are collinear so that the intermediate connecting tube (1) is inserted into the central hole (6) and passes through the matching hole (10), and when the applied force on the button part (5) is released, the button part (5) moves in the reverse direction under the action of the elastic member (9) so that the edge area of the matching hole (10) is located in the notch (7).

3. The sunshade support according to claim 2, wherein a connecting hole (11) is provided on the button part (5), a fixing member (12) is inserted into the main body part (8) and passes through the connecting hole (11) so that the button part (5) is connected with the main body part (8), the connecting hole (11) is a waist-shaped hole, and the button part (5) is movable in the direction of extending into or out of the main body part (8) in the horizontal direction with respect to the fixing member (12).

4. The sunshade support according to claim 1, wherein a beam (17) for suspending items is provided on the buckle structure, and the beam (17) is located on the bottom surface of the buckle structure.

5. The sunshade support according to claim 1, wherein the sunshade support further comprises a foot tube (18), one end of the four top folding tubes (3) away from the connecting piece (2) is connected to the corresponding foot tube (18), respectively, and a scissor-shaped cross iron tube (19) is connected between two adjacent foot tubes (18) in the circumferential direction of the sunshade support.

* * * * *